US005223097A

United States Patent [19]

Hassler

[11] Patent Number: 5,223,097

[45] Date of Patent: Jun. 29, 1993

[54] METHOD FOR CONTROLLING PITCH ON A PAPER-MAKING MACHINE

[75] Inventor: Thord G. G. Hassler, Helsingborg, Sweden

[73] Assignee: W. R. Grace AB, Helsingborg, Sweden

[21] Appl. No.: 368,972

[22] Filed: Jun. 20, 1989

Related U.S. Application Data

[63] Continuation of Ser. No. 263,963, Oct. 26, 1988, abandoned, which is a continuation of Ser. No. 1,611, Jan. 8, 1987, abandoned.

[30] Foreign Application Priority Data

Jan. 9, 1986 [GB] United Kingdom ..... 8600506

[51] Int. Cl.[5] ..... D21H 23/50

[52] U.S. Cl. ..... 162/161; 162/166; 162/167; 162/199; 162/DIG. 4

[58] Field of Search ..... 162/161, 166, 167, 72, 162/DIG. 4, 199

[56] References Cited

U.S. PATENT DOCUMENTS

| | | |
|---|---|---|
| Re. 28,807 | 5/1976 | Panzer et al. . |
| Re. 28,808 | 5/1976 | Panzer et al. . |
| 2,595,935 | 5/1952 | Daniel et al. . |
| 3,016,325 | 1/1962 | Pattiloch . |
| 3,071,504 | 1/1963 | Dunklin et al. . |
| 3,081,219 | 3/1963 | Drennen . |
| 3,140,222 | 7/1964 | Michalski et al. . |
| 3,150,035 | 9/1964 | Eddy . |
| 3,154,466 | 10/1964 | Nothum . |
| 3,274,050 | 9/1966 | Buckman et al. . |
| 3,288,770 | 11/1966 | Butler . |
| 3,384,536 | 5/1968 | Sandberg et al. . |
| 3,514,398 | 5/1970 | Schaper . |
| 3,573,089 | 3/1971 | Tate . |
| 3,582,461 | 6/1971 | Lipowski et al. . |
| 3,589,521 | 6/1971 | Richter . |
| 3,617,441 | 11/1971 | Farrell . |
| 3,617,444 | 11/1971 | Hundseid . |
| 3,619,351 | 11/1971 | Kolosh . |
| 3,632,507 | 1/1972 | Witt . |
| 3,738,945 | 6/1973 | Panzer et al. ..... 210/736 |
| 3,738,945 | 6/1973 | Panzer et al. . |
| 3,748,220 | 7/1973 | Gard . |
| 3,784,649 | 1/1974 | Buckman . |

(List continued on next page.)

FOREIGN PATENT DOCUMENTS

| | | |
|---|---|---|
| 692896 | 8/1964 | Canada . |
| 692897 | 8/1964 | Canada ..... 162/199 |
| 1096070 | 2/1981 | Canada . |
| 1136032 | 11/1982 | Canada . |
| 1150914 | 8/1983 | Canada . . |
| 0053316 | 6/1982 | European Pat. Off. . |
| 0058621 | 8/1982 | European Pat. Off. . |
| 0069573 | of 1983 | European Pat. Off. . |
| 0280445 | of 1988 | European Pat. Off. . |
| 0289341 | of 1988 | European Pat. Off. . |
| 6155294 | of 1986 | Japan . |
| 1014667 | 12/1965 | United Kingdom . |
| 1213745 | 11/1970 | United Kingdom . |
| 1486396 | 9/1977 | United Kingdom . |
| 1495363 | 12/1977 | United Kingdom . |
| 2085433A | 4/1982 | United Kingdom . |
| 2160538A | of 1985 | United Kingdom . |
| 2159511A | 12/1985 | United Kingdom . |
| 2141130 | 11/1986 | United Kingdom . |

OTHER PUBLICATIONS

Sanborn "Non-Biological Deposits Associated With Slime Problems", *Paper Trade J.*, Mar. 25, 1965, pp. 42–43.

(List continued on next page.)

*Primary Examiner*—Steve Alvo
*Attorney, Agent, or Firm*—James P. Barr

[57] ABSTRACT

A method for the control of pitch in an aqueous system used in pulp or paper making is disclosed which comprises adding to the system, or to the pulp making or paper making machinery, a water soluble polymer derived from (a) an epihalohydrin, a diepoxide or a precursor of an epihalohydrin or diepoxide, (b) an alkyl amine having a functionality with respect to an epihalohydrin of 2 and (c) an amine which has a functionality with respect to an epihalohydrin greater than 2 and which does not possess any carbonyl groups.

17 Claims, No Drawings

U.S. PATENT DOCUMENTS

| | | | |
|---|---|---|---|
| 3,806,405 | 4/1974 | Heidweiller . | |
| 3,855,299 | 12/1974 | Witt . | |
| 3,876,500 | 4/1975 | Csordas et al. . | |
| 3,910,815 | 10/1975 | Shelor . | |
| 3,981,768 | 9/1976 | Lehtinen . | |
| 3,992,249 | 11/1976 | Farley . | |
| 4,066,494 | 1/1978 | Scharf et al. . | |
| 4,077,930 | 3/1978 | Lim et al. . | |
| 4,116,762 | 9/1978 | Gardiner . | |
| 4,144,123 | 3/1979 | Scharf et al. . | |
| 4,154,648 | 5/1979 | Osterberg et al. . | |
| 4,166,894 | 9/1979 | Schaper . | |
| 4,184,912 | 1/1980 | Payton . | |
| 4,190,491 | 2/1980 | Drennen et al. . | |
| 4,250,269 | 2/1981 | Buckman et al. . | |
| 4,253,912 | 3/1981 | Becker et al. . | |
| 4,270,978 | 6/1981 | Fioravanti . | |
| 4,295,931 | 10/1981 | Dumas . | |
| 4,427,491 | 1/1984 | Radvan et al. . | |
| 4,451,376 | 5/1984 | Sharp | 162/161 |
| 4,484,981 | 11/1984 | Fuchs et al. . | |
| 4,540,469 | 9/1985 | Lundstrom . | |
| 4,556,453 | 12/1985 | Meinecke . | |
| 4,608,123 | 8/1986 | Leahy . | |
| 4,689,374 | 8/1987 | Hansson et al. . | |
| 4,698,133 | 10/1987 | Moreland . | |
| 4,710,267 | 12/1987 | Elsby et al. . | |
| 4,715,931 | 12/1987 | Schellhammer et al. | 162/199 |
| 4,765,867 | 8/1988 | Driesbach et al. . | |

OTHER PUBLICATIONS

Grace Product Bulletin-Darasperse GR 911-W. G. Grace AB-1982-08-90-2 pages (Translation attached-3 pages).

Grace Product Information-Darasperse 7951-Grace Service Chemicals, Dearborn Chemicals, Ltd.-pp. 1-2.

Grace Product Information-Darasperse 911-Grace Service Chemicals, Dearborn Chemicals, Ltd.-pp. 1-2.

Product Bulletin-Magnifloc 573C-American Cyanamid Company Sep. 1978 3 pages.

Teroson Product Bulletin-GR 911-pp. 1-2 (Translation attached-3 pages).

AGEFLOC B-50 Technical Information; CPS Chemical Co., Inc. pp. 1-3.

W. J. Auhorn et al.; "Improved Efficiency of Wet End Additives in Closed Wet End Systems Through Elimination of Detrimental Substances"; 1979 TAPPI Papermakers Conference; pp. 49-66.

C. E. Farley, "Causes of Pitch Problems and a Laboratory Method of Evaluations Control Agents"; 1977 TAPPI Papermakers Conference; pp. 23-32.

WLK Schwozer (ed.) "Polyelectrolytes for Water and Wastewater Treatment"; CRC Press Inc., pp. 26-35.

D. Horn "Optisches Zweitstrahlverfahren zur Bestimmung von Polyelektroyten in Wasser und zur Messung der Polymerdadsorption an Grenzflächen," Progr. Colloid & Polymer Sci., 65, pp. 251-264 (1978).

May et al, "A Versatile New Polymer for Use in the Manufacture of Paper and Paperboard" Appita vol. 32, No. 6, May 1979, pp. 466-468.

Casey, Pulp and Paper, vol. II, 2nd ed. p. 1096-1097.

Chemical Abstracts vol. 105, p. 107 entry 105:99426q

Gossens et al. "Flocculation of Microcrystalline Cellulose Suspensions with Cationic Polymers"; Effect of Agitation: TAPPI vol. 59, No. 2, Feb. 1976, pp. 89-94.

Louche et al. "The Role of Special Electrolytes for the Solution of Operating Problems in Paper and Board Production".

Gard, "Some Procedural Aspects of Chelation in Papermaking" TAPPI vol. 47, N. 1 (1964) pp. 198A-201A.

METHOD FOR CONTROLLING PITCH ON A PAPER-MAKING MACHINE

This is a continuation of application Ser. No. 263,963, filed Oct. 26, 1988, now abandoned, which is a continuation of application Ser. No. 001,611, filed Jan. 8, 1987, now abandoned.

This invention relates to the control of pitch in the manufacture of pulp and paper.

It is well known that "pitch" can accumulate in paper making and also in the manufacture of pulp, causing significant problems. "Pitch" is the term used to describe the sticky materials which appear in paper making; these originate from the wood from which the paper is made. However, nowadays when more recycled paper is used, "pitch" is now used as a general term for all material soluble in organic solvents but not soluble in water, for example the ink or adhesive present in recycled paper. The pitch can accumulate at various points in the system. For example, it can block the felt and thus hinder drainage of the paper web. In addition, it can adhere to the wires or drying cylinders causing it to pick holes in the paper. Deposits may also build up at any earlier stage in the papermaking process. When these deposits break loose they may form a defect in the paper such as a spot or a hole. Such defects may even create a weakness in the paper sufficient to induce a breakage in the paper during the production resulting in unappreciated production down-time.

Many materials have been used in an attempt to eliminate these problems. Such materials include inorganic treatments such as talc and anionic dispersants. However, conventional dispersants can be ineffective in a closed system as there can be a build-up of "pitch". In such systems the pitch particles have to be removed from the water system in a controlled way without being allowed to accumulate on the felt or rolls or, for example, the pipe work used in the paper making machinery. These products have also been found to give a limited effect and there is a need for further improved treatments.

It has now been found, according to the present invention, that certain water soluble poly-quaternary amines are particularly effective for this purpose. Accordingly, the present invention provides a method for the control of pitch in an aqueous system used in pulp or paper making which comprises adding to the system or to the pulp making or paper making machinery, a water soluble polymer derived from (a) an epihalohydrin, a diepoxide or a precursor of an epihalohydrin or diepoxide, (b) an alkyl amine having a functionality with respect to an epihalohydrin of two, and (c) an amine which has a functionality with respect to an epihalohydrin greater than two and which does not posses any carbonyl groups.

A special feature of the products used in the present invention is that they may combine with dissolved anionic material originating from the wood from which the pulp and paper is produced, providing a method of removing these anionic materials thereby lowering the concentration of such materials in the process water. Water soluble anionic materials are released from the wood during pulp manufacture. These components interfere with paper production negatively in several ways: they decrease the efficiency of many products used in the papermaking process to alter the character of the paper. Examples of such additives include sizes, wet and dry strength agents and dyes. Anionic dissolved materials also reduce the efficiency of retention agents. They limit the extent to which the water system can be closed and they may also lower the quality of the paper such as its strength. Reference is made to TAPPI papermakers Conference 1979 p49–66 which further discusses, the significance of anionic dissolved materials.

Component (a) is preferably an epihalohydrin, especially epichlorohydrin or epibromohydrin, but dihalohydrins, preferably dichlorohydrins or dibromohydrins, having three to twenty, especially three to ten, carbon atoms per molecule may also be used. Typical dihalohydrins which may be used include the following:

$CH_2ClCHClCH_2OH$
$CH_2ClCH_2(OH)CH_2Cl$
$CH_3CHClCHClCH_2OH$
$CH_3CHClCH(OH)CH_2Cl$
$CH_3CH_2CHClCHClCH_2OH$
$CH_3CHClCHClCH(OH)CH_3$
$CH_3CH_2CHClCH(OH)Cl$
$CH_3CH_2CH(OH)CHClCH_2Cl$
$CH_3CHClCH(OH)CHClCH_3$

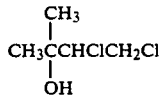

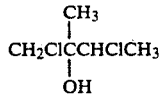

and

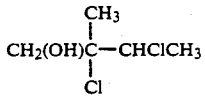

As regards component (b) the alkyl amine may be a compound possessing two tertiary amino groups such as N,N,N',N'-tetramethyleneethylenediamine. Details of the preparation of products derived from such component (b) and component (a) can be found in UK-A-1 486 396. However, component (b) is preferably a dialkylamine in which the alkyl groups individually contain one to three atoms. Dimethylamine is especially preferred.

As previously indicated, component (c) is an amine which possesses a functionality greater than two with respect to epihalohydrin and which does not possess any carbonyl groups, it can therefore act as a branching agent. It has been found that the use of a branched polymer is an important feature in the performance of the polymer to prevent deposition of pitch, an the comparative experiments below show. A primary amino group is capable of reacting with three molecules of epihalohydrin so that a simple primary amine possesses a functionality of three. Likewise, a simple secondary amine will possess a functionality of two and a simple tertiary amine a functionality of one. Accordingly, component (c) is typically ammonia, a primary amine, a primary alkylene polyamine having four to twenty-five, preferably four to twelve, carbon atoms and at least one, preferably one to six, primary amino groups per molecule including polyglycolamines as well as aromatic and heteroaromatic diamines but not polyamidoamines because they possess carbonyl groups. Preferred materials include ammonia, diethylaminobutylamine, dimethylaminopropylamine and ethylenediamine, the latter two being especially preferred.

If desired, the polymer may also be derived from a further component which generally has the ability to act as a "end-capping" agent. In general, these materials will also be amines or other material having reactivity towards epichlorohydrin and which possess a functionality less than two and which also possess some other functional group or a fatty chain of, say, at least 12 carbon atoms, such as a simple tertiary amine such as a trialkylamine, especially trimethylamine or a hydroxyalkylamine, typically triethanolamine, or a fatty amine such as octadecylamine.

The polymers used in the present invention may be prepared by first reacting components (a) and (b) to obtain a "coupling agent" and then reacting this with component (c) and, if desired, the fourth component. Preferred polymers for use in the present invention include those in which the coupling agent is derived from epichlorohydrin and dimethylamine, which is subsequently reacted with ethylenediamine and, if desired, also with trimethylamine, triethanolamine or octadecylamine.

The polymers may also be prepared by reacting a mixture of components (b) and (c) with component (a). The preferred raw materials for such a process are the same as those given above.

In general, the reaction is carried out in an aqueous medium, typically maintaining the reaction temperature at 5° to 125° C., preferably 30° to 95° C. The equivalent ratio of component (b) to component (c) is suitably 1:0.009 to 1.0 and preferably 1:0.02 to 0.5 while the equivalent ratio of component (a) to components (b) and (c) may vary widely depending on the amount and nature of component (b). Generally, the ratio of component (c) to component (a) and component (b), together should be selected so that the viscosity of the aqueous polymer solution is at least 20 Cps at 50% dry content. Typically, the ratio is from 1:0.22 to 2.5 and preferably 1:0.25 to 1.3. In general, the reaction can be continued until the desired viscosity, and therefore molecular weight, has been achieved although acid can be used to reduce the pH and thereby terminate the reaction. A pH of 1 to 7.5, especially 2 to 6.5, is generally preferred for the final solution.

The upper viscosity limit is not critical provided it is consistent with having a workable solution; the upper limit is normally about 2000 Cps.

Further details regarding the polymers which can be used and their preparation is to be found in, inter alia, UK-A-2 085 433, U.S. Pat. No. 3,855,299 and U.S. Pat. No. Re. 28 808 and, for certain polymers, in "Polyelectrolytes for Water and Wastewater Treatment", ed W. L. K. Schwoyer, CRC Press Inc, pages 26–35. A particularly preferred polymer for use in the present invention is formed by reacting ethylenediamine with a precondensate of dimethylamine and epichlorohydrin, and reacting the product with triethanolamine to form a water-soluble reaction product. Another preferred product is formed by reacting a mixture of dimethylamine and ethylenediamine or dimethylaminopropylamine with epichlorohydrin to form a water-soluble reaction product.

The polymer is generally added to the aqueous system with the furnish containing the paper pulp but it is possible to add it at different points in the system depending on the precise nature of the problem.

The amount of polymer required will, of course, depend to some extent on the nature of the wood or other material used to prepare the paper pulp. Also, some polymer once added will tend to recirculate in the system thus requiring a lower addition rate. In general, however, from 0.1 to 20 ppm of polymer by weight based on the aqueous medium is suitable. Preferably, the amount is 1 to 10 ppm. This corresponds in the normal case to an addition of 10 to 2,000 grams, preferably 100 to 1,000 grams, polymer per tonne fibre. However, in cases where the polymer is required to neutralize anionic dissolved materials, generally higher amounts are desirable, in the normal case from 1,000 grams to 50,000, especially from 1,500 to 15,000 grams, per tonne fibre depending on the process by which the fibres are produced (see, for example, Progr. Colloid & Polymer Sci. 65, 251–264 (1978) for a discussion of the amounts of anionic material likely to be present). Fibres produced by a mechanical process generally require a higher addition than fibre prepared by a chemical process. It is, of course, also possible to only partly neutralize the total amount of dissolved anionic materials. In such cases amounts from as little as, say, 10 grams per tonne of paper may be effective.

Sometimes it can be preferred to spray the reaction produce used in this invention onto a particular part of the pulp- or paper-making machinery such as the wire or press felts. In such cases, the polymer is preferably pre-diluted with water, generally to a concentration below 10% by weight and preferably 1 to 5% by weight.

In some instances, it will be convenient to add the polymer together with a biocide. Examples of suitable biocides include those in the following classes:

(i) a substituted 5- or 6-membered ring heterocyclic compound in which the hetero atom or atoms are one or more of nitrogen, oxygen or sulphur and the substituent is an alkyl group, a keto group or a hydroxyl group or a halogen atom, such compounds include isothiazolones, and in particular, those having the formula:

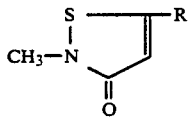

wherein R represents hydrogen or chlorine. A blend of these two isothiazolones is commercially available, the weight ratio of the chloro-substituted compound to the unsubstituted compound being about 2.66:1;

(ii) a phenol or chlorinated phenol such as pentachlorophenol;

(iii) an amine or amide including 2,2-dibromo-3-nitrilopropionamide;

(iv) an organic cyanide or thiocyanate, particularly methylene bis(thiocyanates);

(v) a sulphone including halosulphones, particularly hexachlorodimethylsulphone;

(vi) a straight chain aliphatic aldehyde, particularly glutaraldehyde;

(vii) a triazine, particularly thio and/or amino-substituted alkyl triazines;

(viii) bis bromo acetoxy butene; and (ix) a dithiocarbamate, especially the monomethyl, dimethyl, monoethyl and diethyl derivatives, typically in the form of sodium salts.

The polymer is generally compatible with the usual pulp and paper making additives including starch, for example potato or corn starch, titanium dioxide, a defoamer such as a fatty acid alcohol, a size, for example a rosin size based on abietic acid, a neutral size based on alkyl ketene dimer or a succinic acid anhydride based size and a wet strength resin such as, if neutral, an epichlorohydrin polyamide or, if acid, a melamine- or ureaformaldehyde resin.

The precise nature of the pH of the system is unimportant since the effectiveness of the polymer is substantially unaffected by changes in pH.

Some of the polymers used in the present invention are commercially available, typically as aqueous solutions containing a concentration of 40 to 50% percent. Typically, the compositions used in the present invention will possess from 1 to 70%, especially 10 to 30%, by weight of the polymer.

The following examples further illustrate the present invention.

EXAMPLE 1

Into a reaction flask fitted with reflux condenser, mechanical stirrer and thermometer were placed 183.5 g of 32.7% dimethylamine and 270 g of water. 76.04 g of 36% hydrochloric acid was added while maintaining a temperature maximum of 35° C. by cooling. 208.12 g epichlorohydrin was added during 30 minutes. Cooling was applied to keep the temperature not above 40° C. This temperature was maintained for two hours to produce a stock solution of so-called "coupling agent". 176.9 g of the aqueous solution of the coupling agent was, using the same equipment, heated to 60° C. 5.94 g of ethylenediamine was added dropwise over a 30 minute period. The temperature was then kept at 60° C. for one hour. The reaction mixture was heated to 90° C. and 32.48 g of 30% trimethylamine was added during ten minutes; 90° C. was then maintained for two hours and the reaction mixture cooled to room temperature. This reaction mixture had a total solids content of 40.7%.

EXAMPLE 2

Using the equipment described in Example 1, 25.35 g of 36% hydrochloric acid was added to a mixture of 68.81 g of 32.7% dimethylamine solution and 121.4 g water. The temperature was kept below 35° C. by cooling. 83.25 g epichlorohydrin was added at such a rate that temperature was maintained at 40° C. This temperature was then kept for one hour. The reaction mixture was heated to 60° C. and 7.5 g ethylene diamine was added over 15 minutes while maintaining the temperature at 60° C. This temperature was kept for another 30 minutes. The reaction mixture was heated to 90° C. and 37.25 g triethanolamine was added dropwise over 30 minutes. This temperature was maintained for a further two hours to complete the reaction. The total solids content was 44.6%.

EXAMPLE 3

The products prepared in Examples 1 and 2 were evaluated using essentially the method described in 1977 TAPPI paper makers Conference p 23–32 by Ch E. Farley. This method is built on TAPPI Standard Method RC324 which is a recognised method for evaluating depositability of pitch. The standard pitch solution was prepared as described in the above references. A synthetic pitch emulsion/dispersion was prepared by adding one liter volume of deionised water at 50° C. to the synthetic pitch to reach a 1200 ppm concentration.

A solution of calcium chloride was added to reach a hardness of 340 ppm expressed as calcium carbonate. The pH was adjusted to 8.0. To evaluate the products as pitch control agents, the products were added to obtain a concentration of polymer as specified in Table I. The depositability of the pitch was evaluated according to the procedure in the above references. The test duration was always five minutes. The results are presented in Table I (mg deposited pitch).

TABLE I

| PRODUCT | CONCENTRATION (PPM) | DEPOSITED PITCH (MG) |
|---|---|---|
| Blank | — | 280 |
| Example 1 | 2 | 252 |
| Example 1 | 10 | 2 |
| Example 2 | 2 | 255 |
| Example 2 | 10 | 28 |

COMPARATIVE EXAMPLE 1

An aminoplast resin was prepared essentially according to Example III in U.S. Pat. No. 3,582,461 for comparison.

84 g (1 mole) of dicyandiamide, 196 (2.4 moles) of 37% by weight inhibited aqueous formaldehyde solution, 126 g (mole) of 85% active formic acid were charged into a 1 liter four neck flask equipped with an agitator, thermometer and condenser. The mixture was agitated for 0.5 hours at room temperature. External heat was applied to the reaction mixture and the mixture was heated to 60° C. over a 0.5 hour period. The reaction temperature was gradually raised from 60° C. to the boiling point of the mixture. The exothermic reaction, which occurred when the temperature was raised above 60° C., was controlled by intermittent cooling. The boiling point of the reaction mixture was reached after three hours heating. The mixture was boiled for 15 minutes and then cooled rapidly to 55° C. 42 g of methanol was added to etherify free methylol groups and the mixture was agitated for 2.5 hours and then cooled to 25° C. The resulting reaction product was a water soluble dicyandiamide-formaldehyde condensate in the form of a clear water soluble syrup containing 40% by weight solids.

This resin was evaluated according to procedure in Example 3 with the following results.

| Concentration (ppm) | Deposit (mg) |
|---|---|
| Blank | 299 |
| 2 ppm | 293 |
| 10 ppm | 80 |

COMPARATIVE EXAMPLE 2

Some other products with potential as pitch control agents were evaluated following the procedure of Example 3 with the following results.

| Product | Concentration | Deposit (mg) |
|---|---|---|
| Blank | — | 299 |
| Polyacrylate | 100 ppm | 212 |
| Cationic starch | 100 ppm | 94 |
| Paper makers' alum | 100 ppm | 41 |

EXAMPLE 4

To a mixture of 68.81 g of 32.7% dimethylamine and 121.4 g water was added 25.35 g of 36% hydrochloric acid dropwise over 30 minutes. The temperature of the reaction mixture was not allowed to exceed 35° C.; some cooling was required. 83.25 g of epichlorohydrin was added at such a rate that the temperature of the reaction mixture was maintained at 40° C. After the exothermic reaction was completed the solution was maintained at 40° C. until it became clear (1 hour). After heating to 60° C., 7.5 g of ethylenediamine was added quickly over 5 minutes. The reaction mixture was maintained at 65° C. for a further hour. The reaction mixture was then cooled to room temperature. To 97.42 g of this solution was added 22.56 g octadecylamine (2 moles) and 7.5 g 2-methoxy ethanol (to assist solution). This slurry was slowly heated to 70° C. and maintained at this temperature for 30 minutes. Further heating to 75° C. produced a highly exothermic reaction which required external cooling to maintain a temperature of 75° C. After completion of the exothermic reaction, the mixture was heated at 90° C. for 2 hours. The product, which was in the form of a creamy emulsion, had a total solid content of 18%.

EXAMPLE 5

The product of Example 4 was evaluated using the method described in Example 3, but a different synthetic pitch was used. This time a pitch solution was made by adding a mixture of 2.0 g tall oil and 20.0 g glycerol ester of rosin to 10.5 g 5% potassium hydroxide to form an emulsion. This was then diluted with 187.5 g isopropanol and 110 g acetone to form a clear pitch solution. 15 ml of this solution was added to one liter water at 20° C. and a hardness of 200 ppm expressed as calcium carbonate. The pH was adjusted to 3.0 using concentrated hydrochloric acid and the test was carried out over three minutes.

| Concentration (ppm) | Deposit (mg) |
|---|---|
| Blank | 250 |
| 2 | 72 |
| 3.5 | 23 |
| 7.5 | Nil |

COMPARATIVE EXAMPLE 3

Polydiallyl dimethyl ammonium chloride (poly DADMAC) is another poly quaternary resin suggested at a pitch control agent, in European Patent Application 58 621. This resin was tested following the procedure in Example 5.

| Concentration (ppm) | Deposit (mg) |
|---|---|
| 2 | 193 |
| 5 | 45 |
| 10 | 27 |

COMPARATIVE EXAMPLE 4

The preferred type of quaternary compound for control of pitch deposition in U.S. Pat. No. 3,619,351 is a methyltriethanolamine. This material was synthesized from triethanolamine and dimethyl sulphate to form quaternary ammonium methyl triethanolamine monomethyl sulphate. This material was evaluated using the procedure in Example 3 with the following results:

| Concentration (ppm) | Deposit (mg) |
|---|---|
| Blank | 130 |
| 10 ppm | 166 |
| 100 ppm | 102 |

COMPARATIVE EXAMPLE 5

A resin was prepared only from dimethylamine and epichlorohydrin following essentially the procedure of Example 1 of U.S. Pat. Reissue No. 28,807. A 500 ml round bottom flask equipped with condenser, mechanical stirrer, thermometer and pH electrodes was used for the preparation. 92.5 grams (1.0 mole) epichlorohydrin was added to the flask. 112.5 grams of 40% aqueous dimethylamine (45 grams real, 1.0 mole) was added with vigorous stirring over one hour keeping the temperature below 50° C. Heating was applied for another two hours at 50° C. whereafter 70 g water was added. The viscosity of this resin was determined to be 72 cps and dry content was found to be 47 percent.

EXAMPLE 6

The same equipment as in Comparative Example 5 was used; 63.5 g water, 9 g ethylenediamine and 121.9 g aqueous solution (36.9%) of dimethylamine was added to the reaction flask. 170 g epichlorohydrin was added over a three hour period maintaining the temperature below 35° C. by cooling. Temperature was then increased to 80° C. 11.8 g epichlorohydrin was added in six portions over three hours and after the last addition the reaction mass was kept at 80° C. for an additional two hours, whereafter the product was cooled to room temperature. The product was a pale yellow slightly opaque liquid with a dry content of 65.8% and a viscosity of 190 cps.

EXAMPLE 7

The same equipment as in Comparative Example 5 was used. Water (34.2 g), dimethylamine (60.9 g of an aqueous 36.9% solution) and ethylenediamine (1.5 g) were charged to the reaction flask. 51.0 g epichlorohydrin was added with vigorous stirring over 2 hours. Temperature was raised to 80° C. and 10.6 g epichlorohydrin was added in 9 portions over a 8 hour period. The final product was a slightly opaque, pale yellow liquid. Dry content of this product was found to be 58.8% and the viscosity approx 1000 cps.

EXAMPLE 8

The equipment of Comparative Example 5 was used. A resin was prepared in the following way: 112.5 grams 40% dimethylamine was added to the reaction flask together with 10.2 grams dimethylaminopropylamine. These two amines were mixed and 102 grams of epichlorohydrin was added over 30 minutes with vigorous stirring maintaining a temperature of 30°–40° C. Temperature was then increased to 60° C. which was maintained for 5 hours. During this period of time, 300 ml of deionised water was added in small portions. This resin had a viscosity of 20 cps and a dry content of 33%.

EXAMPLE 9

The products of Comparative Example 5 and Examples 6 to 8 were evaluated following the procedure of Example 5 at an addition of 1.0 ppm polymer with the following results:

| Product | Deposit (mg) |
|---|---|
| Blank | 272 |
| Resin of Example 7 | 201 |
| Resin of Example 6 | 138 |
| Resin of Comparative Example 5 | 228 |
| Resin of Example 8 | 186 |
| Blank | 260 |

EXAMPLE 10

The resin of Example 6 was evaluated using the method of Example 3. The following results were obtained:

| Concentration (ppm) | Deposit (mg) |
|---|---|
| Blank | 133 |
| 2 ppm | 121 |
| 5 ppm | 29 |
| 10 ppm | 6 |

EXAMPLE 11

In order to evaluate the usefulness of polymers to combine with anionic dissolved components of paper pulp the following experiment was made:

A dried groundwood pulp from pine was disintegrated for 30 minutes to prepare a 2.5% furnish. The fibres were subsequently filtered off and the filtrate was used to evaluate the capacity of the resins to combine with dissolved anionic materials. The amount of anionic material was determined with a streaming current detector. Polyethyleneimine (PEI) was used as standard. The efficiency to combine with anionic material was evaluated by adding to the filtrate various amounts of resin, stirring for 15 minutes and subsequently determining the residual concentration of uncombined anionic material by titration with the standard reagent. The results were as follows:

| | PEI mg/l Filtrate |
|---|---|
| Blank | 7,1 |
| 4 ppm of resin of Example 7 | 4,8 |
| 8 ppm of resin of Example 7 | 1,9 |
| 4 ppm of resin of Example 8 | 4,6 |
| 8 ppm of resin of Example 8 | 1,4 |
| 8 ppm of resin of Example 2 | 6,4 |
| 50 ppm of resin of Example 2 | 2,3 |

I claim:

1. A method for controlling the accumulation of pitch on paper-making machinery during paper making in an aqueous paper making system which comprises spraying onto the machinery an effective amount of a water-soluble poly-quaternary amine polymer derived from (a) an epihalohydrin, a diepoxide or a precursor of an epihalohydrin or diepoxide, (b) an alkyl amine having a functionality with respect to an epihalohydrin of 2, and (c) an amine which has a functionality with respect to an epihalohydrin greater than 2 and which does not possess any carbonyl groups, and optionally (d) an end capping agent having a functionality with respect to epichlorohydrin of less than two.

2. A method according to claim 1 for controlling the accumulation of pitch on the wires of paper-making machinery in which the polymer is sprayed onto said wires.

3. A method according to claim 2 wherein prior to spraying the polymer is diluted with water to a concentration below 10 percent by weight.

4. A method according to claim 2 wherein prior to spraying the polymer is diluted with water to a concentration from 1 to 5 percent by weight.

5. A method according to claim 2 in which component (a) is epichlorohydrin or epibromohydrin.

6. A method according to claim 2 in which component (b) is a dialkyl amine in which the alkyl groups individually contain 1 to 3 carbon atoms.

7. A method according to claim 6 in which component (b) is dimethylamine.

8. A method according to claim 2 in which component (c) is a primary amine or a primary alkylene polyamine.

9. A method according to claim 8 in which component (c) is diethylaminobutylamine, dimethylaminopropylamine or ethylene diamine.

10. A method according to claim 2 in which the polymer is also derived from an end capping agent (d) selected from a tertiary amine or a hydroxyalkylamine.

11. A method according to claim 10 in which the end capping agent is trimethylamine or triethanolamine.

12. A method according to claim 2 in which the polymer is derived from a process wherein component (a) is reacted with component (b) to obtain a coupling agent, and said coupling agent is then reacted with component (c) such that component (c) acts as a branching agent.

13. A method according to claim 2 in which the polymer is one derived by reacting ethylene diamine with a coupling agent obtained by reacting dimethyl amine and epichlorohydrin, and then reacting the product of ethylene diamine and said coupling agent with triethanolamine to form a water-soluble reaction product.

14. A method according to claim 2 in which the polymer is derived from a process wherein a mixture of dimethylamine and either ethylene diamine or dimethylaminopropylamine is reacted with epichlorohydrin to form a water-soluble reaction product.

15. A method according to claim 2 in which the polymer is a branched polymer derived from a process wherein components (a), (b) and (c) are reacted such that the equivalent ratio of total functionality possessed by component (c) to total functionality possessed by components (a) and (b) together is from 1:0.22 to 2.5.

16. A method according to claim 1 wherein said polymer is also added to the aqueous medium containing the paper pulp used for paper making; and wherein the polymer is added to the paper making system in an amount from about 10 to 50,000 grams per tonne of fibre.

17. A method according to claim 2 for controlling the accumulation of pitch in a paper making process which uses recycled paper wherein said pitch contains adhesive present in said recycled paper.

* * * * *